US008822397B1

(12) United States Patent
Yu et al.

(10) Patent No.: US 8,822,397 B1
(45) Date of Patent: Sep. 2, 2014

(54) MULTI-PURPOSE SOLVENT CLEANING AGENT COMPRISING SOY EXTRACT AND PARACHLOROBENZOTRIFLUORIDE

(71) Applicant: Building Materials Investment Corporation, Wilmington, DE (US)

(72) Inventors: Lingtao Yu, Nutley, NJ (US); Li-Ying Yang, Whippany, NJ (US)

(73) Assignee: Building Materials Investment Corporation, Dallas, TX (US)

( * ) Notice: Subject to any disclaimer, the term of this patent is extended or adjusted under 35 U.S.C. 154(b) by 0 days.

(21) Appl. No.: 14/038,630

(22) Filed: Sep. 26, 2013

Related U.S. Application Data

(60) Provisional application No. 61/839,535, filed on Jun. 26, 2013.

(51) Int. Cl.

| | |
|---|---|
| ***C11D 3/24*** | (2006.01) |
| ***C11D 3/44*** | (2006.01) |
| ***C11D 7/24*** | (2006.01) |
| ***C11D 7/26*** | (2006.01) |
| ***C11D 7/44*** | (2006.01) |
| ***C11D 7/30*** | (2006.01) |

(52) U.S. Cl.
CPC *C11D 7/44* (2013.01); *C11D 7/247* (2013.01); *C11D 7/264* (2013.01); *C11D 7/30* (2013.01)
USPC ..... 510/204; 610/174; 610/201; 610/202; 610/241; 610/244; 610/245; 610/251; 610/254; 610/256; 610/271; 610/273; 610/365; 610/432; 610/463

(58) Field of Classification Search
USPC ..... 510/174, 201, 202, 204, 241, 244, 245, 510/251, 254, 256, 271, 273, 365, 432, 463
See application file for complete search history.

(56) References Cited

U.S. PATENT DOCUMENTS

| | | | | |
|---|---|---|---|---|
| 6,191,087 | B1 | 2/2001 | Opre | |
| 6,479,445 | B1 | 11/2002 | Machac, Jr. | |
| 6,833,341 | B2 | 12/2004 | Machac, Jr. | |
| 2002/0111284 | A1 | 8/2002 | Machac, Jr. | |
| 2010/0279912 | A1 | 11/2010 | Bortz | |
| 2011/0104501 | A1* | 5/2011 | Watson et al. | 428/425.1 |
| 2011/0183882 | A1* | 7/2011 | Bortz | 510/477 |
| 2012/0190777 | A1* | 7/2012 | Houston et al. | 524/27 |

OTHER PUBLICATIONS

Wolf et al., "Assessment, Development and Demonstration of Alternatives for Five Emerging Solvents," Institute for Research and Technical Assistance, http://www.cdph.ca.gov/programs/hesis/Documents/emergingsolvents.pdf (Oct. 2006).

Zhang, Jorry, "China PCBTF price slightly go up as supply became tight," http://harvestchem.wordpress.com/2012/08/01/china-pcbtf-price-slightly-go-up-as-supply-became-tight/, Henan Harvest Chem Co., Ltd (Aug. 1, 2012).

"Boater Guide to Eco-Friendly Purchasing," CA Dept. of Toxic Substances Control, San Francisco Dept. of Public Health, http://www.sfdph.org/dph/files/EHSdocs/Green/BoatPurchasingGuide.pdf (2011).

* cited by examiner

*Primary Examiner* — Charles Boyer
(74) *Attorney, Agent, or Firm* — Baker & McKenzie LLP

(57) ABSTRACT

Various low VOC compositions of the present disclosure may be suitable for use as surface cleaners. In an exemplary embodiment, the disclosed composition may be used to clean membranes used on roofs and in the roofing industry. In an exemplary embodiment, the disclosed composition comprises various concentrations of soy extract and parachlorobenzotrifluoride (PCBTF). In an embodiment, the composition may further include a VOC and a filler.

15 Claims, No Drawings

MULTI-PURPOSE SOLVENT CLEANING AGENT COMPRISING SOY EXTRACT AND PARACHLOROBENZOTRIFLUORIDE

CROSS-REFERENCE TO RELATED APPLICATION

This application claims priority to U.S. Provisional Patent Application 61/839,535, filed on Jun. 26, 2013, which application is incorporated herein by reference.

TECHNICAL FIELD

The present disclosure relates, in some embodiments, to compositions (e.g., solutions) which may be used as a cleaning agent for various surfaces.

BACKGROUND

Various objects, such as carpet, tile, concrete, and shingles, have exposed surfaces that may receive and accumulate foreign contaminates or materials, such gum, paint, and tar. The accumulation of foreign contaminates on the exposed surfaces may be undesirable aesthetically and/or functionally. To restore the exposed surfaces to its original condition as much as possible, various approaches may be used to remove the foreign contaminates. In one approach, the exposed surfaces may be scrubbed to physically remove the foreign contaminates with frictional and mechanical forces. However, the physical removal of the foreign contaminates may be difficult if a strong bond develops between the exposed surface and the foreign contaminates. Physical removal also can cause unintended damage to the exposed surfaces, thereby decreasing the life of the product. Alternatively, solvents may be used to chemically break the bond between the exposed surface and the foreign contaminates, but these too can cause unintended damage to the exposed surfaces.

SUMMARY

Accordingly, a need exists for compositions and methods for cleaning an exposed surface while limiting or eliminating adverse effects on the treated surface. According to some embodiments, the present disclosure relates to methods and compositions suitable for use in cleaning various surfaces. For example, a composition may be used as a thermoplastic polyolefin (TPO) seam cleaning agent to clean TPO membranes used on roofs and in the roofing industry. A composition may comprise, in some embodiments, soy extract, acetone, parachlorobenzotrifluoride (PCBTF), and/or xylene. A method may comprise contacting a surface (e.g., a surface comprising at least one foreign contaminant) with a cleaning composition in some embodiments. A method may comprise, in some embodiments, making a cleaning composition comprising combining soy extract, acetone, parachlorobenzotrifluoride (PCBTF), and/or xylene in amounts sufficient to produce a composition with desirable and/or required cleaning and/or environmental performance.

DETAILED DESCRIPTION

The present disclosure relates, in some embodiments, to compositions formulated to have properties suitable for cleaning. For example, a composition may be used to clean one or more surfaces. Examples of surfaces to be cleaned may include carpet, tile, concrete, and TPO membranes and examples of materials to be removed may include gum, paint, tar, and other contaminates.

Suitable cleaning agents may be used to clean TPO roofing membranes, which may be made of various materials and have different constructions. Some embodiments of roofing shingles may include thermoplastic polyolefin (TPO). In an installation of TPO roofing membranes, it may be desirable to clean the exposed seams prior to heat welding to remove any residual soap or dirt and revitalize aged membranes. It is desirable to remove substantially all surface materials on the roofing membranes which may obstruct welding or adhering. Contaminant removal may improve weldability and/or maximum load of the roofing structure in some embodiments. Inadequate contaminant removal may negatively impact the weldability and/or maximum load of the roofing structure in some embodiments.

A cleaning agent suitable for cleaning TPO roofing membranes, in some embodiments, may be formulated to include volatile organic compounds (VOCs). According to some embodiments, VOCs may comprise or consist of the compounds identified by the United States Environmental Protection Agency (EPA) in 40 C.F.R. 51.100(s), which defines VOCs as "any compound of carbon, excluding carbon monoxide, carbon dioxide, carbonic acid, metallic carbides or carbonates, and ammonium carbonate, which participates in atmospheric photochemical reactions." The EPA further explains that VOCs are "organic chemical compounds whose composition makes it possible for them to evaporate under normal indoor atmospheric conditions of temperature and pressure," and "[t]his is the general definition of VOCs that is used in the scientific literature, and is consistent with the definition used for indoor air quality." Examples of VOCs may include, in some embodiments, toluene, xylene, methylene chloride and/or like compounds. The EPA excludes certain compounds from the definition of VOCs based on their negligible photochemical reactivity. A comprehensive list of compounds excluded for negligible photochemical reactivity is available at the EPA website at http://www.epa.gov/ttn/naaqs/ozone/ozonetech/def_voc.htm and is incorporated by reference herein.

The generally good solubility of most contaminants in VOCs allows VOC-based solvents to be effective as cleaning agents for many surfaces. However, the use of VOC-based cleaning agents may cause severe environmental and health problems and can be limited by government regulations and local ordinances. For example, excess emission of VOCs may contribute to difficulty breathing, air pollution such as smog and/or ozone, and decreased visibility. Many states in the United States as well as other countries have enacted regulations that limit the use of VOC-based cleaning agents or limit the content of VOCs in cleaning agents. Therefore, it may be desirable to formulate a cleaning agent with low VOC content. In some embodiments, a composition with a "low VOC content" or "low VOC" may have less than about 5% VOC by weight. A VOC concentration near 5% VOC and is still within the limits defined by the regulations of U.S. state and Federal government may be understood to be less than about 5% VOC by weight. In some embodiments, a cleaning agent may be formulated to have a low VOC content and synergistically have good performance as a cleaning agent for TPO roofing membranes. The performance of a cleaning agent for TPO roofing membranes may be evaluated using factors such as cleanability, surface composition analysis, weldability, and maximum loading according to some embodiments.

VOC-based cleaning agents may have, in some embodiments, a low flash point due to the volatility of VOCs in the cleaning agents. Cleaning agents with a low flash point are easily flammable and generally considered to be more hazardous. In some embodiments, a cleaning agent may be formulated to have a low VOC content and synergistically have good a flash point higher than conventional cleaning agents so that the flammability may be reduced.

Some embodiments of the present disclosure may include cleaning agents that have a low VOC content and may synergistically have a relatively high flash point and good performance with respect to TPO roofing membranes. According to some embodiments, a composition may include soy extract, acetone, PCBTF, and xylene and be formulated to allow for synergistic properties with respect to TPO roofing membranes. Soy extract, derived from soybean oil, is based on natural occurring renewable material and is widely regarded as being "green." Examples of soy extracts may include, according to some embodiments, Steposol SB-D (Elwood, Ill.) and Natural S Soy Solvent (Lyndist, Salt Lake City, Utah). Disclosed cleaning agents may include various concentrations of soy extract to allow for low VOC content, synergistic properties with respect to TPO roofing membranes, and reduced flammability.

TABLE 1 lists various examples and comparative examples of cleaning compositions in which the content of each component is shown as a percentage by weight. The illustrated exemplary compositions may be used as cleaning agents for various types of surfaces, such the surface of TPO roofing membranes. As indicated by TABLE 1, exemplary compositions may comprise soy extract and PCBTF in various concentrations. In addition to soy extract and PCBTF, some exemplary compositions may further comprise acetone, xylene, and/or methyl acetate.

TABLE 1

Cleaning Composition Components

| Component | Control | Example 1 | Comparative Example 1 | Example 2 | Comparative Example 2 | Example 3 |
|---|---|---|---|---|---|---|
| Soy Extract | | 10% | | 16.7% | 20% | 28.6% |
| Acetone | | 30% | 33% | 50% | 60% | 28.6% |
| PCBTF | | 60% | 67% | 16.7% | | 38.1% |
| Xylene | 100% | | | | | 4.7% |
| Methyl Acetate | | | | 16.7% | 20% | |
| Cleanability | 4 | 3.5 | 3.5 | 2.8 | 3 | 4 |
| Weldability | 100% | 100% | 90% | 80% | 70% | 100% |
| Max Load (lbf/in) | 28 | 27 | 25 | 21 | 13 | 29 |

Experiments were conducted to determine the effectiveness of each composition as a cleaning agent of TPO membranes. The experiments include an evaluation of the cleanability, weldability, and maximum load of each exemplary composition. Results are shown in TABLE 1. Weldability is graded on a percentage as set forth in ASTM D413. Briefly, a TPO cleaner is used to clean both surfaces to be welded together, a hot air welder is pre-heated to 700° F., the two surfaces are welded together under pressure with the pre-heated welder, the welded membrane(s) are cut into 1 inch strips, an instron/grab machine is used to separate the welded strips, and the weldability percentage is calculated as the exposed scrim area over the welded area. TPO membranes tested have a reinforced scrim between two layers of TPO ply. A good weld will cause exposure of scrim when two welded membranes are separated. The maximum load is measured in pound-force (lbf). To determine the maximum load, surfaces of TPO membranes were cleaned with the compositions disclosure herein, the cleaned surfaces were laminated by heat welding, and the maximum load in pounds per linear foot (lbf/ft) or inch (lbf/in) of the laminated TPO is measured by performing a 180° peel test. Cleanability is graded on a scale of 1 to 5. On the scale, a value of 1 indicates that there is substantially no cleaning of the tested TPO surface; a value of 2 indicates that there are some dirt residues; a value of 3 indicates that the TPO surface may be cleaned with rigorous scrubbing; a value of 4 indicates that the membrane is cleaned with ease, but there is staining reside; and a value of 5 indicates that the membrane is cleaned with ease, and there is no staining residue at all. These aforementioned values fall along a continuous scale. Accordingly, a cleanability value in the accompanying figure that falls between two of the above specified values indicates that the cleanability falls between the two descriptions thereof.

Xylene is a known VOC that may be sued as a cleaning agent. The cleaning performance of a composition comprising 100% xylene is evaluated as a control for comparison with the exemplary compositions disclosed herein. As shown in TABLE 1, a 100% xylene composition exhibits a cleanability of 4, weldability of 100%, and a maximum load of 28 lbf.

The present disclosure provides various exemplary embodiments of low VOC compositions that exhibit satisfactory or even substantially equivalent cleaning performance as xylene and may allow for the various advantages of having reduced or no VOC content as discussed herein. In an embodiment, an exemplary low VOC composition of the present disclosure may include greater than about 10% and less than about 40% by weight soy extract. According to some embodiments, any soy extract suitable for cleaning TPO membranes or other applicable surfaces may be used in the compositions of the present disclosure. An example soy extract may have a density at 25° C. of about 7.3, a flash point of 201° F., a boiling point of about 646° F., a vapor pressure at 20° C. of about 0.5 mm Hg, an evaporation rate of less than about 0.01 (butyl acetate=1), a Kauri-Butanol value of about 59, or combinations thereof. An example soy extract may have a density about 7.9 pounds per gallon, a flash point of more than about 150° F. (ASTM D93 closed cup), a boiling point of about 292° F., a vapor pressure at 68° F. of about 0.9 mm Hg, an evaporation rate of about 0.0098, a Kauri-Butanol value of about 70, or combinations thereof. An exemplary low VOC composition may further include greater than about 15% by weight parachlorobenzotrifluoride (PCBTF). Depending on the amount of PCBTF, the exemplary low VOC composition may be filled out with less than about 5% by weight xylene, and various suitable amounts of acetone and methyl acetate.

In some embodiments, an exemplary low VOC composition of the present disclosure may include greater than about 10% and less than about 30% by weight soy extract. The exemplary low VOC composition may further include greater than about 30% by weight PCBTF. Depending on the amount of PCBTF, the exemplary low VOC composition may be filled out with less than about 5% by weight xylene, and various suitable amounts of acetone and methyl acetate. Such an exemplary low VOC compositions may have cleaning performance that is substantially equivalent or exceeds that of a VOC cleaner.

The example embodiment of a low VOC composition in Example 1 includes about 10% soy extract, 30% acetone, and 60% PCBTF by weight. This composition has a cleanability of 3.5, weldability of 100%, and a load capacity of 27 lbf. The effect of having greater than about 10% soy may be demonstrated by comparing Example 1 to Comparative Example 1 in TABLE 1. In Comparative Example 1, no soy extract is included in the illustrated composition, which includes 33% acetone and 67% PCBTF by weight. As shown in FIG. 1, both the weldability and maximum load of Comparative Example 1 are improved by having about 10% soy extract in Example 1.

The example embodiment of a low VOC composition in Example 2 includes about 16.7% soy extract, 16.7% PCBTF, 50% acetone, and 16.7% methyl acetate. Comparing Example 2 to Example 1, a large amount of PCBTF is replaced by acetone and methyl acetate. Because PCBTF is a better cleaning solvent than acetone, the cleaning performance of Example is satisfactory but not as good as that of Example 1. Comparative example 2 is provided to further illustrate that when PCBTF is not present, the cleaning performance deteriorates and has a non-satisfactory maximum load of 13 lbf. It is to be appreciated that acetone may be considered as a filler in the disclosed compositions, and acetone may be replaced other non-VOC solvents that are either cheaper in cost or exhibit better cleaning properties. Comparative example 2 further illustrates that acetate/methyl acetate is a suitable non-VOC solvent that may replace acetone in part or in whole.

The example embodiment of a low VOC composition in Example 3 includes about 28.6% soy extract, 38.1% PCBTF, 28.6% acetone, and 4.7% xylene. This composition exhibits cleaning performance that even slightly exceeds that of a 100% xylene composition. This example illustrates that less than about 5% VOC suitable for cleaning surfaces may be added to a variety of soy extract and PCBTF concentrations to obtain excellent cleaning performance. In this case, xylene is demonstrated to be a suitable VOC for cleaning TPO or other application surfaces. In other embodiments, other VOCs exhibiting good solvent property as a cleaning agent may be used in concentrations less than about 5% to improve the cleaning performance of the composition disclosed herein.

In view of above example embodiments, low-VOC compositions of the present disclosure may be used as suitable cleaning agents for various surfaces including TPO surfaces. TABLE 2 shows the XPS (X-ray Photoelectron Spectroscopy) surface composition analysis of a field aged TPO roofing membrane with conventional VOC cleaner, with Example 3 low VOC cleaner and without a cleaner. The analysis indicates aged TPO membrane surface cleaned with Example 3 cleaner has the similar surface chemistry as aged TPO membrane cleaned with conventional VOC cleaner. Both cleaners reduce Si and Al (dirt) and O (oxidized component) significantly, rejuvenate and provide the equal cleanabilty on aged TPO membrane. In addition, due to the high flash point of the soy extract and low VOC content, some embodiments of the present disclosure may have a flash point greater than 70° F. In some embodiments, the flash point (e.g., of the example embodiment compositions) may be varied depending on the concentration of the soy extract. For example, the concentration of the soy extract of an example embodiment may be increased to about 15% or greater, even at the expense of slight decrease in cleaning performance, to allow a relatively high flash point. Furthermore, by including some VOC, such as xylene, to improve solvent properties, some of the present embodiments may be synergistically green and safe.

TABLE 2

XPS surface composition analysis*

| Aged TPO membrane surface cleaner | O | Si | Al |
|---|---|---|---|
| No | 22.9(0.6) | 4.9(0.4) | 2.3(0.1) |
| Control/Conventional | 8.5(0.3) | 0.9(0) | ND |
| Invention Example 3 | 8.5(1.4) | 1.5(0.2) | ND |

*Averages (±Std. Dev.)

As will be understood by those skilled in the art who have the benefit of the instant disclosure, other equivalent or alternative compositions, devices, methods, and systems for cleaning a surface can be envisioned without departing from the description contained herein. Accordingly, the manner of carrying out the disclosure as shown and described is to be construed as illustrative only.

Persons skilled in the art may make various changes in the ingredients, flash point, and/or concentration of compositions without departing from the scope of the instant disclosure. For example, the kind and concentration of VOCs and/or soy extract may be varied. In addition, the batch size of a composition may be scaled up or down to suit the needs and/or desires of a practitioner. Each disclosed method and method step may be performed in association with any other disclosed method or method step and in any order according to some embodiments. Where the verb "may" appears, it is intended to convey an optional and/or permissive condition, but its use is not intended to suggest any lack of operability unless otherwise indicated. Persons skilled in the art may make various changes in methods of preparing and using a composition of the disclosure. For example, a composition may be prepared and or used as appropriate for interiour and/or exterior use (e.g., with regard to safety, toxicity, biometry, and other considerations). Elements, compositions, devices, systems, methods, and method steps not recited may be included or excluded as desired or required.

Also, where ranges have been provided, the disclosed endpoints may be treated as exact and/or approximations as desired or demanded by the particular embodiment. Where the endpoints are approximate, the degree of flexibility may vary in proportion to the order of magnitude of the range. For example, on one hand, a range endpoint of about 50 in the context of a range of about 5 to about 50 may include 50.5, but not 52.5 or 55 and, on the other hand, a range endpoint of about 50 in the context of a range of about 0.5 to about 50 may include 55, but not 60 or 75. In addition, it may be desirable, in some embodiments, to mix and match range endpoints. Also, in some embodiments, each figure disclosed (e.g., in one or more of the examples, tables, and/or drawings) may form the basis of a range (e.g., depicted value+/−about 10%, depicted value+/−about 50%, depicted value+/−about 100%) and/or a range endpoint. With respect to the former, a value of 50 depicted in an example and/or table may form the basis of a range of, for example, about 45 to about 55, about 25 to about 100, and/or about 0 to about 100.

All or a portion of a composition and/or method for cleaning a surface may be configured and arranged to be disposable, green, and/or biodegradable. These equivalents and alternatives along with obvious changes and modifications are intended to be included within the scope of the present disclosure. Accordingly, the foregoing disclosure is intended to be illustrative, but not limiting, of the scope of the disclosure as illustrated by the appended claims.

The title, abstract, background, and headings are provided in compliance with regulations and/or for the convenience of the reader. They include no admissions as to the scope and content of prior art and no limitations applicable to all disclosed embodiments.

The invention claimed is:

1. A composition comprising:

a soy extract having a concentration greater than about 10% and less than about 40% by weight;

parachlorobenzotrifluoride (PCBTF) having a concentration greater than about 15% by weight; and a volatile organic compound (VOC) having a concentration less than about 5% by weight.

2. A composition according to claim 1, wherein the VOC comprises xylene.

3. A composition according to claim 1, wherein the concentration of the VOC is about 0% by weight.

4. A composition according to claim 1, wherein the concentration of the VOC greater than about 0% by weight.

5. A composition according to claim 1, wherein the concentration of the soy extract is less than about 30% by weight.

6. A composition according to claim 5, wherein the concentration of the soy extract is greater than about 15% by weight.

7. A composition according to claim 1, wherein the concentration of the PCBTF is greater than about 30% by weight.

8. A composition according to claim 1, further comprising a filler.

9. A composition according to claim 8, wherein the filler comprises acetone.

10. A composition according to claim 8, wherein the filler comprises methyl acetate.

11. A composition according to claim 8, wherein the filler comprises acetone and methyl acetate.

12. A composition according to claim 1, wherein the composition has a flash point of greater than 70 degrees F.

13. A composition according to claim 1, wherein the concentration of the soy extract is greater than about 15% by weight.

14. A composition according to claim 1, wherein the composition has less than about 25 g/l VOC.

15. A composition according to claim 14, wherein the composition has equal cleanability as conventional VOC cleaner characterized by visual cleanability as well as surface chemical analysis.

* * * * *